US011666935B2

(12) United States Patent
Zigdon et al.

(10) Patent No.: US 11,666,935 B2
(45) Date of Patent: Jun. 6, 2023

(54) SELECTIVELY LIFTING SUBSTRATES

(71) Applicant: Hewlett-Packard Development Company, L.P., Spring, TX (US)

(72) Inventors: Chen Zigdon, Ness Ziona (IL); Daniel Skvirsky, Ness Ziona (IL); Roy Beeri, Ness Ziona (IL); Liora Braun, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/257,331

(22) PCT Filed: Nov. 15, 2018

(86) PCT No.: PCT/US2018/061176
§ 371 (c)(1),
(2) Date: Dec. 31, 2020

(87) PCT Pub. No.: WO2020/101678
PCT Pub. Date: May 22, 2020

(65) Prior Publication Data

US 2021/0276037 A1 Sep. 9, 2021

(51) Int. Cl.

| | |
|---|---|
| ***B05C 1/08*** | (2006.01) |
| ***B41J 15/04*** | (2006.01) |
| ***B65H 20/02*** | (2006.01) |
| ***B65H 23/28*** | (2006.01) |
| ***B41J 11/00*** | (2006.01) |

(52) U.S. Cl.
CPC ..... *B05C 1/0826* (2013.01); *B05C 1/0821* (2013.01); *B41J 15/04* (2013.01); *B65H 20/02* (2013.01); *B65H 23/28* (2013.01); *B41J 11/0015* (2013.01); *B65H 2301/5114* (2013.01)

(58) Field of Classification Search
CPC ..... B05C 1/0826; B05C 1/0821; B41J 15/04; B41J 11/0015; B65H 20/02; B65H 23/28; B65H 2301/5114; B65H 2301/51212; B65H 2404/1371; B65H 2404/147; B41F 22/00; Y10S 271/90
USPC ..... 118/245, 200
See application file for complete search history.

(56) References Cited

U.S. PATENT DOCUMENTS

| | | | | |
|---|---|---|---|---|
| 3,693,585 A | | 9/1972 | Reeve et al. | |
| 4,080,159 A | * | 3/1978 | Behun | G03G 15/2028 432/60 |
| 5,228,920 A | | 7/1993 | Thompson | |
| 5,413,806 A | * | 5/1995 | Braun | B05C 1/12 118/712 |

(Continued)

FOREIGN PATENT DOCUMENTS

| | | |
|---|---|---|
| CN | 105750151 A | 7/2016 |
| EP | 1047836 | 2/2003 |

(Continued)

*Primary Examiner* — Laura Edwards

(57) ABSTRACT

Example implementations relate to selectively deflecting substrates. One example implementation includes an apparatus to selectively lift a part of a substrate away from a transfer member when the substrate is advancing in a substrate coating system relative to the transfer member, such that, across a width of the substrate, a first part of the substrate is coated by the transfer member and a second part of the substrate, that is lifted by the apparatus, remains uncoated.

4 Claims, 6 Drawing Sheets

(56) References Cited

U.S. PATENT DOCUMENTS

| | | | | |
|---|---|---|---|---|
| 7,842,332 | B2 | 11/2010 | Teramoto et al. | |
| 2004/0021741 | A1 | 2/2004 | Ottenheimer et al. | |
| 2004/0055145 | A1 | 3/2004 | Buswell | |
| 2005/0092146 | A1 | 5/2005 | Carbone et al. | |
| 2006/0147636 | A1* | 7/2006 | Cooprider ..... | B05C 1/0808 118/400 |
| 2017/0080705 | A1 | 3/2017 | Shmaiser et al. | |

FOREIGN PATENT DOCUMENTS

| | | | |
|---|---|---|---|
| EP | 2826631 | | 1/2015 |
| EP | 3283301 | A1 | 2/2018 |
| JP | 2002263549 | * | 9/2002 |
| WO | WO2015/064685 | * | 5/2015 |
| WO | 2016/165740 | A1 | 10/2016 |
| WO | WO-2018231192 | | 12/2018 |

* cited by examiner

SELECTIVELY LIFTING SUBSTRATES

BACKGROUND

In some substrate coating systems, such as a priming system and/or printing system, a primer is transferred to a substrate before the substrate is printed on. In some printers, sometimes referred to as a press, a substrate coating system is included. In such printers, the primer acts as an undercoat layer to a print layer and improves bonding of the print layer to the substrate. The print layer occurs where the primer is present, such that, areas void of primer corresponding to unprinted areas.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
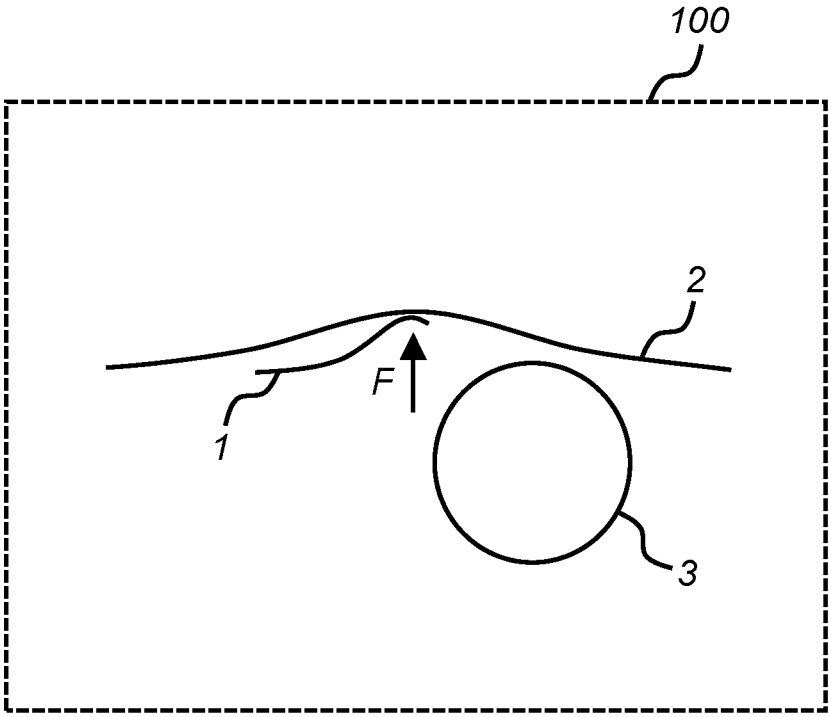
FIG. 1 is a schematic view of an apparatus to selectively lift a part of a substrate away from a transfer member in accordance with an example.

In the following description, for purposes of explanation, numerous specific details of certain examples are set forth. Reference in the specification to "an example" or similar language means that a particular feature, structure, or characteristic described in connection with the example is included in that one example, but not necessarily in other examples.

In some substrate coating systems, such as a priming system and/or printing system (including digital printing systems and analog printing systems) a method of priming a substrate is performed in a priming process. Some printers can be regarded as a substrate coating system or can comprise a substrate coating system. In some printers, such as a digital printer or press and/or an analog printer or press, the priming process is performed prior to the printing process that comprises printing on the substrate. In some instances, the substrate is referred as a medium or coatable medium. The medium may be referred to as a print medium when the medium is to be passed through a printer because the substrate can receive printing fluid, for example, ink from the printer. The substrate can be a web of material. The substrate may be a film. The priming process involves coating at least a portion of one side of the substrate with a primer, which can be referred to as a coating surface. After the priming process and after the primer has dried, the substrate is printed on in a printing process. The primer is a coating substance and, in most instances, is a fluid. The primer provides a base layer for the printing fluid. The base layer is sometimes referred to as an undercoat. In some instances, such as for in-line printers, a print job includes both the priming process and the printing process. Such in-line printers are therefore printers that combine the application of the primer to the substrate and the subsequent application of the printing fluid. In in-line printers, the substrate is fed continuously between a primer system and a print system.

In a priming system, a primer is transferred to a substrate using a transfer member, such as a transfer roller. The transfer member picks up primer from a storage, such as a chamber, and applies the primer to a surface of the substrate. In most instances, a doctor blade is used to wipe excess primer from the surface of the transfer member to ensure an even exposure of the substrate to primer. When the primer reaches the substrate, the substrate is coated. In instance, when a transfer roller is used to apply prime the substrate, the transfer roller rotates about an axis to transport the primer from the storage and to a substrate surface. One type of transfer roller is an anilox roller, which is described in more detail below. In most instances, a doctor blade is a thin, elongate member that substantially extends along a dimension of the transfer member, such as the length of a transfer roller. The doctor blade is to divert excess primer away from the transfer member. In some instances, an area of a doctor blade is in communication with a storage tank such that excess primer can be removed and possibly reused within the printer.

In an indirect priming mode, the transfer member transfers primer to an intermediate member before the intermediate member transfers the primer to the substrate. In a direct priming mode, the transfer member transfers the primer directly to the substrate without the intermediate member.

Some priming systems directly transfer the primer from the transfer member to the substrate in the direct priming mode. For example, as the transfer roller rotates, primer attached to a surface of the transfer is passed straight to the substrate. In some instances, a "kiss" mode is used to transfer the substrate. A "kiss" mode is an example of a direct priming mode wherein a transfer member or a span of substrate is brought just close enough to the other to transfer primer to the substrate with minimal disturbance to a path of movement of the substrate. The bringing together of the transfer member and substrate, which may result in engagement, is controlled to ensure primer is transferred effectively. In some instances, the transfer member touches the substrate via the primer and without the primer, the transfer member would not contact the substrate. The light contact is enough for the primer to switch from the transfer member to the substrate without pressing the primer to the substrate. When a transfer roller is used, the transfer is made between a tangential surface of the transfer roller and the substrate. A surface speed of the transfer roller may be substantially equal to a speed of traverse of the substrate. However, the surface speed of the transfer roller may be above or below the speed of the substrate. In some instances, the control of the transfer member to engage and/or disengage the substrate is performed manually. In other instances, the engagements and/or disengagement may be by a controller to actuate an electromechanical, pneumatic or hydraulic means.

To transfer the primer to the substrate, a transfer roller may rotate in the same direction as the substrate, such that there is little or no relative movement between the transfer roller and substrate. In other instances, a direction of movement of the transfer roller may be in a direction opposite to the direction of movement of the substrate. When using a "kiss" mode transfer, the process of opposing the motion of the transfer roller and the substrate is referred to as a "reverse kiss" mode.

A gravure roller is a type of transfer roller. Coating a substrate with a gravure roller may be referred to as gravure coating. Gravure coating is a process of producing continuous coatings on a substrate. The gravure roller comprises depressions or recesses on an application surface. The depressions or recesses are to control a thickness and uniformity of a coated layer on the substrate. Fluid, such as primer, is uniformly "picked out" of the depressions or recesses and transferred to the substrate. In most instances, the pattern of depressions or recesses is regular to enable a continuous and uniform coating is applied. The gravure roller is specifically designed to avoid damage to the substrate during the coating process because substrates can be susceptible to scratching.

One example of a gravure roller is an anilox roller. The anilox roller comprises a transfer element containing a precisely manufactured microstructure forming cells to precisely control a volume and distribution of primer to the substrate. The distribution of the transfer element across the anilox roller determines the distribution of primer on the substrate. In most instances, the transfer element is an outer layer of a cylinder that rotates about an axis. The cells are to receive primer and may be engravings. The transfer element may therefore comprise etched, machined, or knurled recesses on its surface which can be any shape or size, discontinuous, or continuous over the roller surface. The volume of these recesses controls the average coating thickness, and the specific geometry can be designed to enhance the stability of a pickout of the primer from the recesses. The ability to accurately control the volume and shape of these recesses together with the stability of the pickout of a regular fraction of the fluid in these recesses improves coating thickness uniformity in the substrate.

As the anilox roller rotates, the primer is deposited on the transfer element and is transferred to a substrate by way of rotation of the anilox roller. The anilox roller provides a desirable metering of the primer onto the substrate. The distribution of the transfer element across the anilox roller determines the distribution of primer on the substrate.

In some instances, an entire width of a substrate is coated by primer. Such a process is referred to as flood coating because the substrate is effectively flooded by primer. Other priming modes include lane coating, which involves coating the substrate with a primer in a lane arrangement. In lane coating, a transfer roller coats portions of the substrate to form lanes of coated and uncoated regions.

When using an anilox roller, the transfer element of the anilox roller is spaced across the anilox roller to provide a plurality of spaced cell regions. The spaced regions allow primer to be transferred to the substrate in lanes. In most instances, the lane pattern is fixed for each anilox roller. To prime a substrate with a different lane pattern, a second anilox roller, with a differently distributed transfer element is needed. The second anilox roller replaces the anilox roller currently installed in the printer and the printing process resumes once the second anilox roller is installed in the printer. Therefore, to change the lane pattern, a different anilox roller is used. An operator disengages the anilox roller from the substrate and removes the anilox roller from the printer. Given that anilox rollers are precisely manufactured, changing the anilox roller is performed carefully by a trained operator. Once the anilox roller is removed, the anilox roller is stored for later use. The anilox roller may be stored with an array of anilox roller that provide an array of lane patterns. To ensure good priming quality, the anilox roller is treated with care. Any damage to the cells of the anilox roller effect priming quality.

FIG. 1 schematically illustrates an apparatus 1 to selectively lift a part of a substrate 2 according to an example. In the example, the substrate 2 is advancing in a substrate coating system 100 relative to a transfer member 3, such as a transfer roller. The apparatus 1 is to lift the substrate 2 away from the transfer member 3, such that, across a width of the substrate 2, a first part of the substrate 2 is coated by the transfer member 3 and a second part of the substrate 2, that is lifted by the apparatus 1, remains uncoated.

The term to lift is not intended to be limited by direction. The term lift may refer to a sideways or downwards direction and not just an upwards direction. The apparatus lifts the substrate 2 to move the substrate 2 away from the transfer member 3 to avoid a coating of the substrate by the transfer member 3. The movement of the substrate 2 is a deflection of the substrate 2 from a transport path. The transport path may comprise an imaginary line drawn tangentially between two rollers. The imaginary line may be in a transfer zone. In most instances, a majority of the substrate 2 follows the imaginary line, except for sections of the substrate 2 that interact with the apparatus 1 and are lifted by the apparatus 1.

The substrate coating system 100 shown in FIG. 1 may be a printer such as a Digital Offset Color Printer. In other examples, the printer may be an analog printer.

Digital Offset Color printing, sometimes also referred to as Liquid Electrophotography (LEP), is the process of printing in which liquid toner is applied onto a surface having a pattern of electrostatic charge (i.e. a latent image) to form a pattern of liquid toner corresponding with the electrostatic charge pattern (i.e. a developed image). This pattern of liquid toner is then transferred to at least one intermediate surface, such as a surface of a blanket of an image transfer medium, and then to a print medium. During the operation of a liquid electrophotographic system, developed images are formed on the surface of a PIP. These developed images are transferred to a blanket, that is heatable and may be provided around a cylinder, and then to the substrate.

According to the example of FIG. 1, the apparatus is called a deflector 1. The deflector 1 is to transfer a force F to a tensioned substrate 2 in the substrate coating system 100 and to selectively urge the substrate 2 away from the transfer member 3. The selective urging of the substrate 2 by the deflector 1 is to cause the substrate to move away from the transfer member 3. When urged by the deflector 1 across a width of the substrate 2, a first part of the substrate 2 is coated by the transfer member 3 and a second part of the substrate 2, that is lifted by the deflector 1, remains uncoated.

Figure 2:
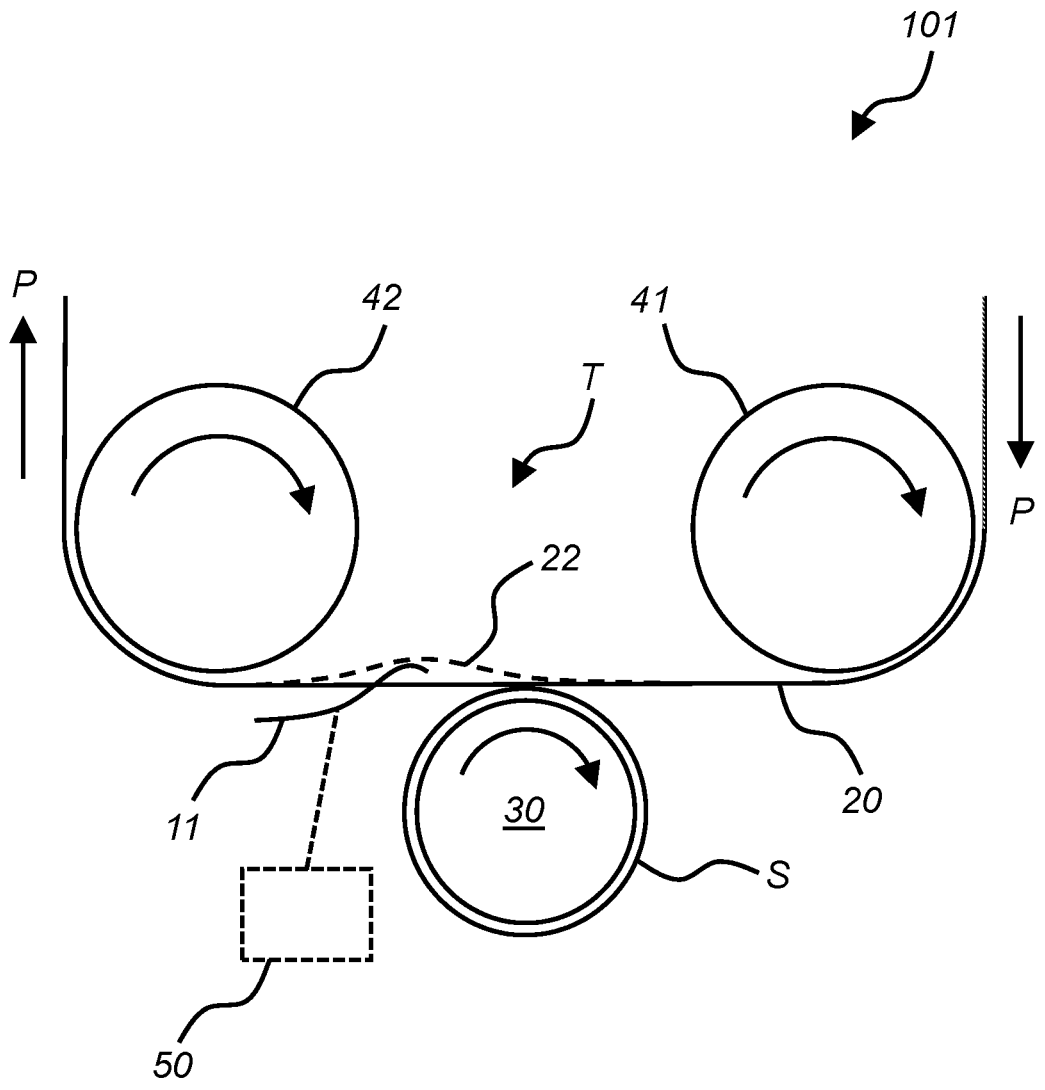
FIG. 2 is a schematic view of a printer in accordance with an example.

FIG. 2 schematically illustrates a printer 101 according to an example. The printer 101 comprises a priming system. The priming system is an example of a substrate coating system. The priming system comprises a transfer member 30 to transfer a substance S, such as a primer, to a substrate 30 under tension. The tension of the substrate 30 is achieved by a pair of tension rollers 41, 42. The tension rollers 41, 42 form part of the priming system of the printer 101. The substrate 30 is a web of print media. The transfer member 30 is a gravure roller, such as an anilox roller. A mechanism 50 that is mounted relative to the transfer member 30 is shown. The mechanism 50 may be referred to as an adjuster 50. The mechanism 50 comprises a guide member 11 that forms part of the priming system of the printer 101. The guide member 11 is moveable between a first position and a second position. In the first position, the guide member 11 is disengaged from the substrate 20, and in the second position, the guide member 11 is engaged with the substrate 20 to lift a portion 22 of the substrate 20 away from the transfer member 30 and avoid transfer of the primer S from the transfer member 30 to the lifted portion 22 of the substrate 20.

Furthermore, an adjuster 50 that is arranged to position the guide member 11 relative to the transfer member 30 is shown. The substrate 20 is to be deflected by the guide member 11 based on a position of the guide member 11. The guide member 11 is to therefore guide a portion 22 of a width of the substrate 20 away from the transfer member 30 to avoid transfer of the substance S from the transfer member 30 to the guided portion 22 of the substrate 20. Unguided portions of the substrate 20 are coated by the substance S. The guide member 11 is to guide the substrate 20 by relative movement between the guide member 11 and the substrate 20.

The substrate 20 is coated by the substance S in a transfer zone T. The transfer zone T is a region of the priming system of the printer 101 wherein the transfer member 30 applies the substance S to the substrate 20. Referring to FIG. 2, the transfer zone T exists between the two tension rollers 41, 42 in a free span of the substrate 20 between the tension rollers 41, 42.

The guide member 11 shown in the priming system of the printer 101 of FIG. 2 may correspond to the deflector 1 of FIG. 1. The guide member 11 is to lift a part of the substrate 20 when the substrate 20 passes across the guide member 11 in the same way that the deflector 1 is to lift the substrate 20.

The transfer member 30 and tension rollers 41, 42 may be driven independently. That is, rotation of the transfer member 30 is caused by a different means than rotation of the tension rollers 41, 42. For example, the priming system may comprise a first driving member to drive the transfer member 30 and a second driving member, that is different to the first driving member, to drive the tensions rollers 41, 42. The first driving member may be a motor (not shown). The second driving member may be the substrate 20. In this example, the tension rollers 41, 42 act as idler rollers because the tension rollers 41, 42 are driven by the movement of the substrate 20 across the tension rollers 41, 42.

In the example of FIG. 2, the transfer member 30 is shown centered between the tension rollers 41, 42. In other examples, a contact region or a wiping surface of the guide member 11 may be centered between the tension rollers 41, 42.

A tension applied by the tension rollers 41, 42 is enough to avoid buckling in a width direction of the substrate 20 and frequency fluctuations in the span of substrate 20.

As shown in FIG. 2, the substrate 20 travels along a transport path P. The substrate 20 first passes a first tension roller 41 and then travels to the transfer member 30 before being conveyed away from the transfer zone T by a second tension roller 42. The transfer member 30 rotates in a direction opposite to the direction of travel of the substrate 20. This is an example of the "reverse-kiss" transfer mode. The transfer member 30 deposits the substance S, such as a fluid coating material or primer, onto a coating surface of the substrate 20. The substance S is deposited on the coating surface by lifting the substance S from a storage chamber (not shown). The depositing process therefore includes a wetting of the coating surface by the substance S to pick up the substance on the coating surface. The substance S is then temporarily stored in the transfer member 30, for example by cells of a gravure pattern, before being transported and applied to the coating surface of the substrate 20. Some regions of the substrate 20, such as the portion 22 of a width of the substrate 20 shown in FIG. 2, are urged away from the transfer member 30. The urged portions do not contain a deposited substance S because the lifting of the urged portions prevents the application of the substance S onto the urged portions. As the substrate 20 is conveyed through the printer 101, the substrate 20 comprises a coated lane and a coated lane due to the use of the guide member 11. A lane coating mode is provided without the need to change the transfer member 30. That is, a width portion of the transfer member 30 is prevented from transferring substance S to the substrate 20 by deflection of the guide member 11.

In FIG. 2, the guide member 11 is located downstream of the transfer member 30. In some instances, such as the example shown in FIG. 3, the apparatus 11 (the guide member 11 in the example of FIG. 2 and the deflector 110 in the example of FIG. 3), may be located upstream of the transfer member 30. That is, in the example of FIG. 2, the guide member 11 is to contact the substrate 20 at a position downstream of the transfer member 30. However, in some instances, the guide member 11 is to contact the substrate 20 at a position upstream of the transfer member 30. In either case, a contact portion of the guide member 11 is located between the transfer member 30 and the substrate 20. The contact portion may be made of Teflon. The contact portion is to physically engage with and wipe a surface of the substrate 20. The contact portion is designed to avoid damage to the substrate 20 so that scratches in the substrate 20 are prevented. Suitable materials for the contact portion include metals, such as steel, and plastic. In tests conducted by the Applicant, the results shown in Table 1 were found:

TABLE 1

| Test results | | | |
|---|---|---|---|
| Material/Thickness/ Width | Substrate | Priming quality | Lane width |
| Hard steel/ | PETG | Very good | 8-10 mm |
| 0.1 mm /5 mm | Laminated tube | Very good | 8-10 mm |
| Hard steel/ | PETG | Very good | 8-10 mm |
| 0.3 mm/5 mm | Laminated tube | Very good | 8-10 mm |
| Plastic/ | PETG | Very good | 4-6 mm |
| 0.2 mm/3 mm | Laminated tube | Very good | 4-6 mm |

The above tests results were obtained from a guide member 11 as shown in FIG. 2. The substrate 20 was either PETG (polyethylene terephthalate) or a laminated tube. The material of the guide member 11 was either hard steel or plastic. A thickness of the guide member was either 0.1, 0.2 or 0.3 mm and a width of the contact portion was either 3 or 5 mm. Each guide member 11 produced an uncoated lane width of no more than double the width of the contact portion. The quality of priming did not vary and accurate coating was achieved. In the testing, it was found that a contact portion with a width of 5 mm provided more stable lanes than a width of 3 mm. Furthermore, the plastic guide member 11 did not produce any scratches.

Referring to FIG. 2, the adjuster 50 positions the guide member 11 relative to the transfer member 30 such as a transfer roller. The adjuster 50 holds a location of the guide member 11 to resist an opposing force from the substrate 20. A controller (not shown) may be used to adjust the mechanism 50, shown as an adjuster 50, to vary a position of the guide member 11 relative to the transfer member 30. A suitable controller is a lead screw because precise position control is achievable with a lead screw. The adjuster 50 is to maintain a position of the guide member 11 to prevent contact of the guide member 11 with the transfer member 30 and avoid transfer of the substance S to the guide member 11. In some examples, the guide member 11 may touch the substance S on the transfer member 30 much like a doctor blade.

The controller may include electromechanical control. The controller may control the relative position of the guide member 11 and the transfer member during a print job. That is, the guide member 11 may move "on-the-fly". The guide member 11 may move across a width of the substrate 20 to change the lane pattern. The print job includes a priming event. The print job may further include a printing event. When the priming event and printing event is performed as a combination in a print job, the priming event and printing event may be said to be in-line.

The adjuster 50 may be a support member, such as a rail. The support member may provide a range of positions of the guide member 11 across the support member. For example, when the adjuster 50 is a rail, the rail may span a width of the transfer member 30. The guide member 11 may be moveable along the rail, wherein the degree of movement may be discrete or continuous. The controller may move the guide member 11 and/or may hold a position of the guide member 11 relative to the adjuster 50.

Figure 3:
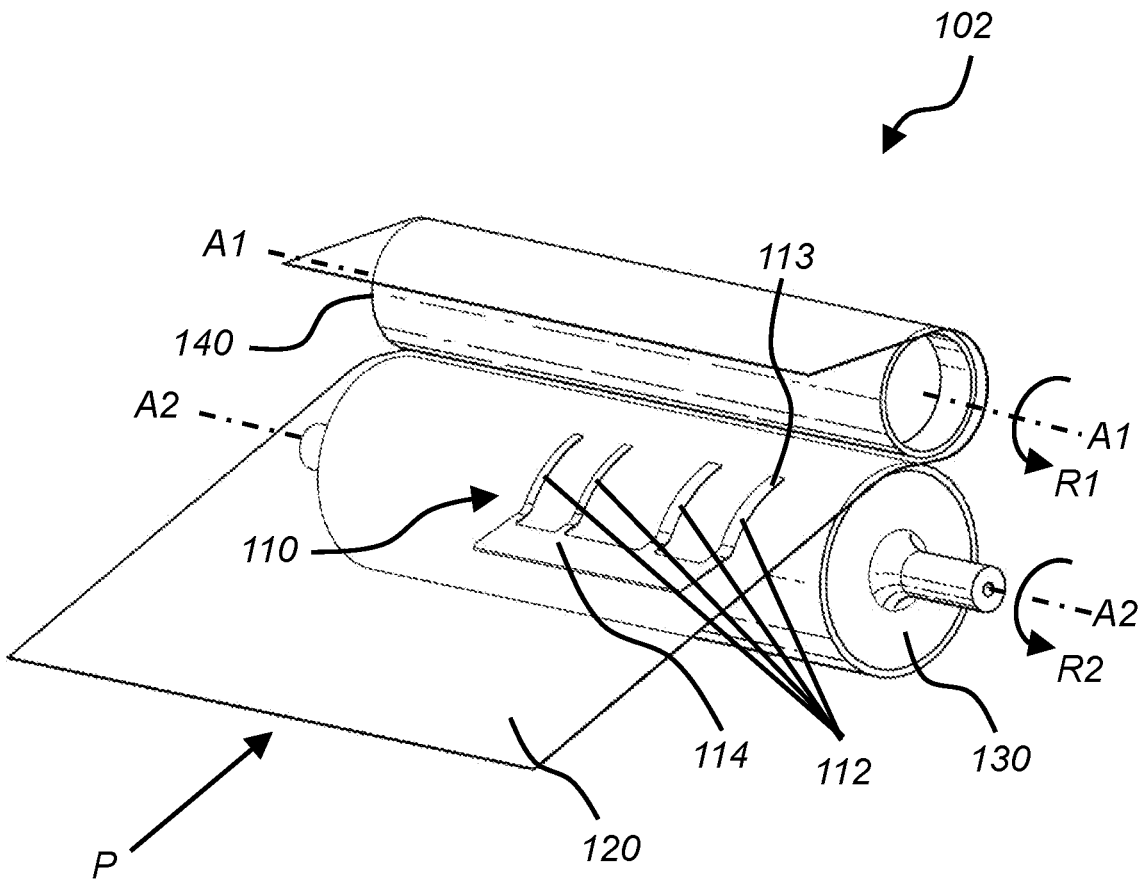
FIG. 3 is a perspective view of a printer in accordance with another example.

FIG. 3 schematically illustrates a perspective view of an example printer 102. The printer 102 comprises a tensioned substrate 120 that is transported along a path P by a tension roller 140. The tension roller 140 rotates about an axis A1 in direction R1. The direction R1 is an anti-clockwise direction. The tensioned substrate 120 passes across a transfer roller 130, such as an anilox roller, so that a fluid is coated on the substrate 120. The transfer roller 130 rotates about an axis A2 in direction R2. The direction R2 is also a anti-clockwise direction, which is the same direction as the tension roller 140. The axes A1, A2 of the tension roller 140 and the transfer roller 130 are parallel. The tension roller 140 and the transfer roller 130 do not engage at a nip because a "reverse-kiss" transfer mode is shown. A deflector 110 is shown between the substrate 120 and the transfer roller 130 to disturb a free span of substrate 120 and route the substrate 120 away from the transfer roller 130. In the example of FIG. 3, the deflector 110 is to contact the substrate 120 before the fluid is coated on the substrate 120 and at a position upstream of the transfer member 130. Such routing of the substrate 120 creates a lane of uncoated substrate 120 corresponding to the contact point between the deflector 110 and the substrate 120.

The deflector 110 comprises a plurality of members 112. The members are referred to as wipers 112 because the members are slideable across a surface of the substrate 120. In some instances, a single wiper 112 may be used. Each wiper 112 may be referred to as a finger 112 or a lifting finger. The wiper 112 is to provide gliding contact with the substrate 120 so as freely slide across the surface of the substrate and not adhere to the substrate 120.

The deflector 110 of FIG. 3 therefore comprises four wipers 112. Each wiper 112 extends away from a body or a base 114 of the deflector 110. The base 114 and each wiper 112 are integral to one another. In some examples, the base 114 and each wiper 112 may be separate components that are brought together and assembled. This allows a wiper 112 to be removed for maintenance, repair or replacement purposes.

The base 114 may be coupled to an adjuster such as that shown in FIG. 2. The adjuster helps to maintain a position of the deflector 110 and opposes a force transferred form the substrate 120 and through each wiper 112 to the base 114. In other instances, the deflector 110 may be moveable relative the adjuster, for example the base 114 of the deflector 110 may be slideable along the adjuster. The base 114 may therefore comprise an aperture or recess to receive a portion of the adjuster to allow the base 114 to slide along the adjuster. The adjuster therefore serves to support the deflector 110 and hold a position of engagement between the deflector 110 and the substrate 120. In some instances, a controller may be used such as a screw or a bolt that locks a relative position of the adjuster and the deflector 110. The controller therefore controls a relative position of the deflector 100 and the adjuster.

In the example shown in FIG. 3, each wiper 112 extends from the base 114 to respective tip 113. The tip may physically engage with and wipe a surface of the substrate 120. The wiper 112 comprises an arcuate portion. The arcuate portion comprises the tip 113. The arcuate portion of each wiper 112 is to cause a gradual lift of the substrate 120 across the respective wiper 112. This aids the transfer of force to the substrate 120 to avoid damage to the substrate 120. The arcuate portion of the deflector 110 is a non-linear contact portion that engages with an makes direct physical contact with the substrate 120.

The wipers 112 of the deflector 110 shown in FIG. 3 are spaced apart. An inner spacing formed between adjacent wipers 112 is greater than an outer spacing. In some instances, the spacing between each wiper may be different. The spacing between the wipers 112 is to control the width of the uncoated lanes and the coated lanes. In the example shown, the relative arrangement of the wipers 112 of the deflector 110 is fixed. To change the lane pattern, a different deflector 110 with a different spacing can be used. Alternatively, in other examples, a different width of the wiper 112 can be used to change the lane pattern.

In some instances, a plurality of deflectors 110 may be positioned by an adjuster. The plurality of deflectors 110 may be further moveable relative to the adjuster. The degree of movement may be controlled by a controller. The controller may further hold the relative position of the deflector and adjuster. The space between adjacent deflectors 110 may be changed to affect a width of a coated lane on the substrate 120.

Figure 4:
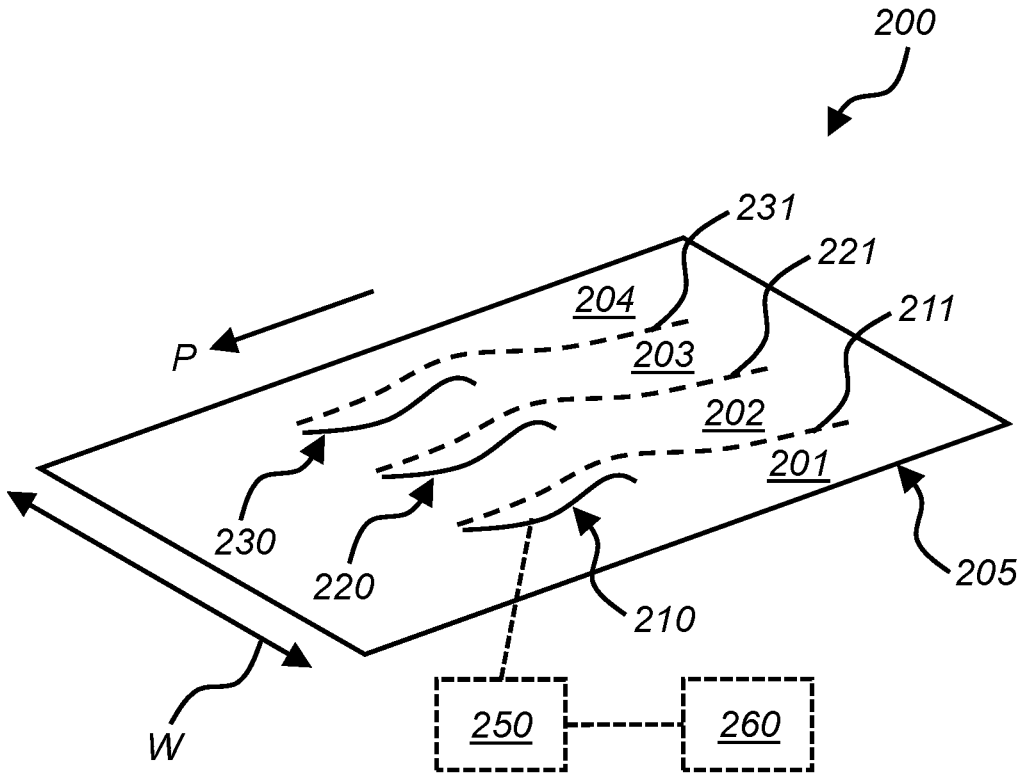
FIG. 4 is a schematic perspective view of a transfer zone in a printer in accordance with an example.

Referring to FIG. 4, a schematic perspective view of a transfer zone 200 in a priming system of a printer in accordance with an example is shown. In FIG. 4, a substrate 205, an array of spaced wipers 210, 220, 230, an adjuster 250 and a controller 260 is shown. The controller 260 interacts with the adjuster as previously described above.

In some instances, the array of wipers 210, 220, 230 are part of the same deflector. In other instances, at least one of the wipers 210, 220, 230 is part of a first deflector and another one of the at least one of the wipers 210, 220, 230 is part of second deflector. In the latter case, a plurality of deflectors can be used, wherein each deflector comprises at least one wiper.

The transfer zone 200 in FIG. 4 generally relates to the same transfer zone T shown in FIG. 2. In the transfer zone 200 of FIG. 4, an array of wipers 210, 220, 230 are distributed across a width W of the substrate 205. As the substrate is moved in an example transport path P, each wiper 210, 220, 230 is to direct a force to a respective portion 211, 221, 231 of the substrate 205. The transfer of force causes the respective portions 211, 221, 231 to be lifted away from a transfer member (not shown) such as the transfer member 30 in FIG. 2 to avoid primer deposits on the substrate 205 in these portions. Each portion 211, 221, 231 that is lifted may be considered a raised portion. Adjacent portions 201, 202, 203, 204 do not physically engage with the respective wipers 210, 220, 230 and come into contact with the primer, which results in a lane coating process.

Figure 5:
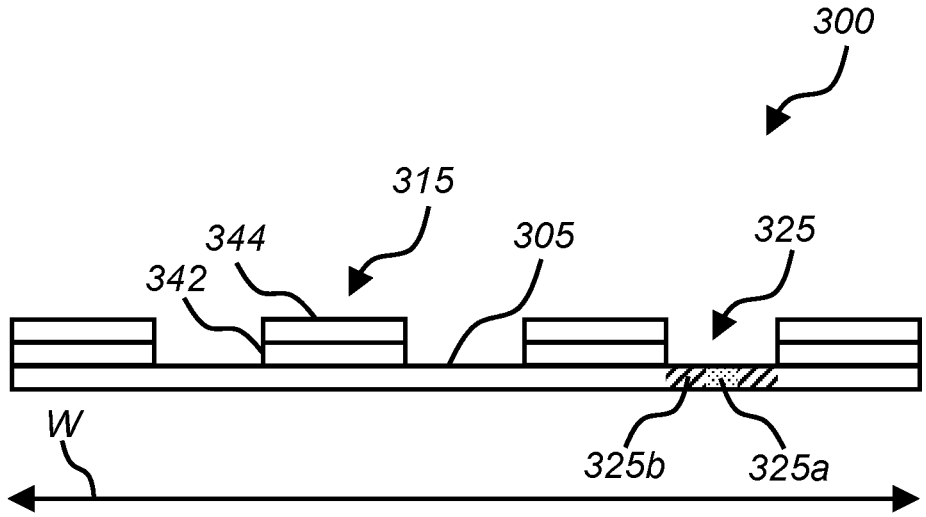
FIG. 5 is a schematic cross-sectional view of a coated substrate in accordance with an example.

Turning to FIG. 5, a schematic cross-sectional view of a coated substrate 300 in accordance with an example is shown. The cross-sectional view is a view into a length of substrate 300, such that a width W of substrate 300 is shown. The coated substrate 300 comprises lanes of primer and printing fluid that are present on one side of the coated substrate 300 and not the other side of the coated substrate 300.

As shown in FIG. 5, a first coating layer is a primer layer 342. A second coating layer is a printing fluid layer 344. The presence of the printing fluid is limited to where the primer layer 342 is present. In the example shown, four coated lanes 315 are produced and three uncoated lanes 325 are produced. Each coated lane 315 is an example of a first part of the substrate 305 and each uncoated lane 325 is an example of a second part of the substrate 305.

In the uncoated lane 325, a first portion 325*a* directly contacts a wiper of a deflector, such as that shown in FIG. 4. The first portion 325*a* therefore receives a force directly from the wiper to urge the uncoated lane 325 away from a transfer member. An adjacent second portion 325*b* (two adjacent second portions 325*b* are shown in FIG. 5) are also deflected away from the transfer member by the deflector but do not directly receive the force from the wiper. The adjacent second portion 325*b* therefore forms part of the uncoated lane 325 but does not come into physical contact with the wiper. In some examples, the uncoated lane 325 is less than or equal to twice a width of the wiper. When the wiper has a width of 5 mm, the width of the uncoated lane 325 may be 8-10 mm. In this instance, a width of the first portion 325*a* will correspond to the width of the wiper and the remaining amount 3-5 mm will be comprised by a width of the second portions 325*b*.

Figure 6:
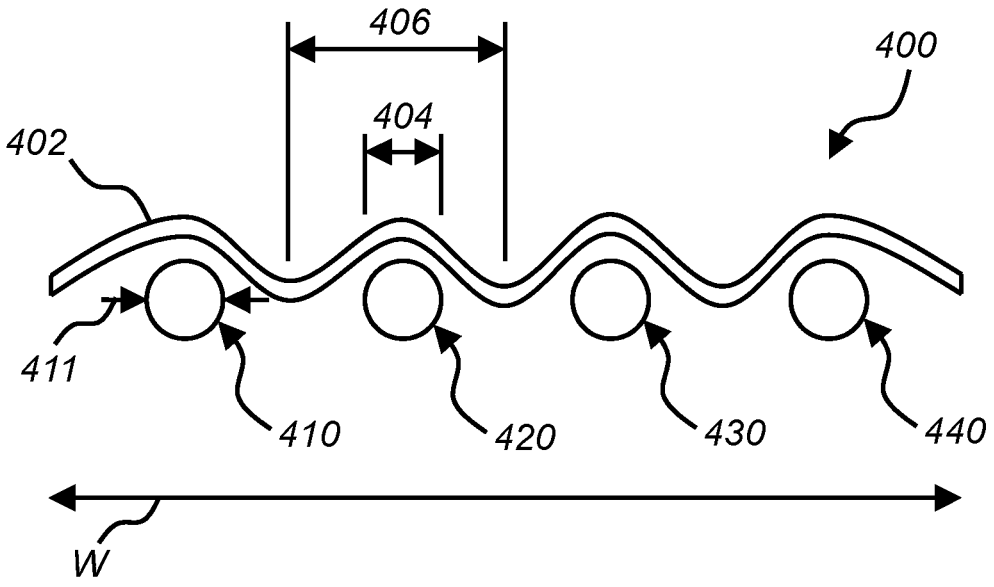
FIG. 6 is a schematic cross-sectional view of a transfer zone in accordance with another example.
Figure 7:
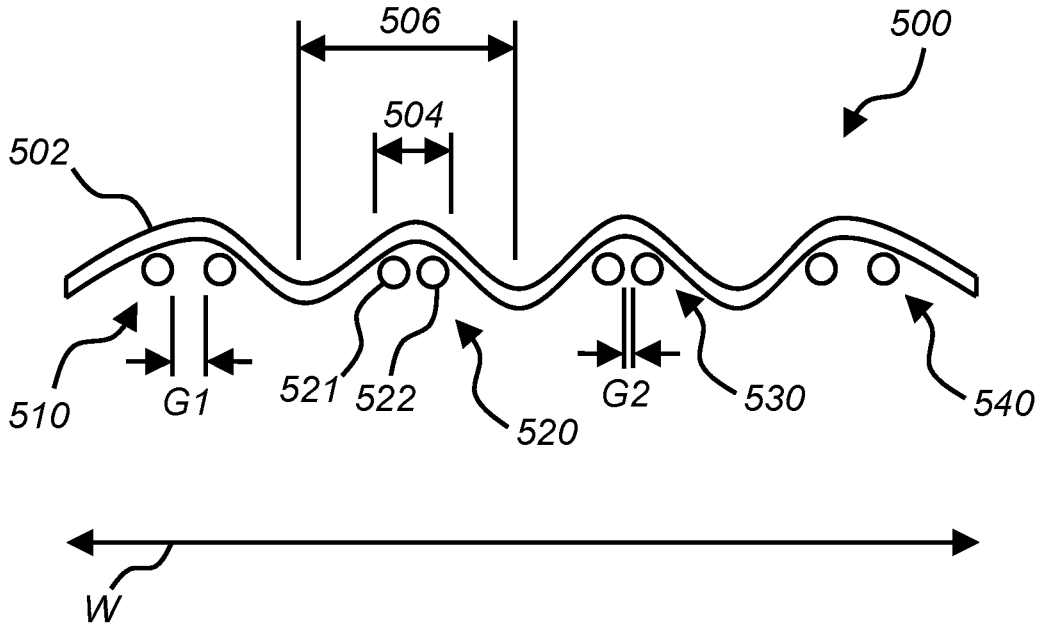
FIG. 7 is a schematic cross-sectional view of a transfer zone in accordance with another example.

Referring to FIGS. 6 and 7, schematic cross-sectional views of respective example transfer zones 400, 500 are shown. The cross-sectional views are views into a length of substrate 402, 502, such that a respective width of substrate 402, 502 is shown. In the example transfer zones 400, 500, an array of wipers is shown. The array of wipers may formed part of one deflector or a plurality of deflectors. The difference between the transfer zones 400, 500 of FIGS. 6 and 7 is that the array of wipers 510, 520, 530, 540 comprises a plurality of elements 521, 522. The elements 521, 522 are referred to as wiping elements 521, 522 because the elements are slideable across a surface of the substrate 502. Therefore, in the example of FIG. 7, each wiping element 521, 522 is to wipe and lift a different portion of the same second part of the substrate 502, wherein the second part forms an uncoated lane. Therefore, one of the wiping elements 521, 522 is spaced apart from another one of the wiping elements 521, 522, so that each wiping element 521, 522 is to direct a force to a respective portion of the second part of the substrate.

As shown in FIG. 6, the transfer zone 400 has a width W which is less than a width of a substrate 402 because the substrate 402 is temporality distorted by an array of wipers 410, 420, 430, 440. Each wiper 410, 420, 430, 440 comprises a width 411 which corresponds to a portion 404 of the substrate 402 that is lifted away from a transfer member. The portion 404 is a fraction of a part of the substrate 402 that is lifted but just the portion 404 is physically wiped by contact with the wiper 410, 420, 430, 440. The lifted part of the substrate 402 forms an uncoated lane.

Although, a circular cross-section of a wiper 410, 420, 430, 440 is shown in FIG. 6, different cross-sectional shapes are possible. For example, the wiper may comprise a linear portion. The linear portion may be the contacting portion that is to physically engage with the substrate 402. The contacting portion may additionally or alternatively comprise non-linear portions. The contacting portion may comprise non-linear edges to improve the spread of force to the substrate 402 so as to avoid damage to the substrate 402. The edges of the contacting portion may be beveled or chamfered, for example.

As shown in FIG. 7, each wiper 510, 520, 530, 540 comprises a plurality of wiping elements 521, 522. Each of the plurality of wiping elements 521, 522 may be comprised by the same deflector or different deflectors. For example, one deflector may comprise a plurality of wiping elements 521, 522 and a plurality of deflectors may act across a width of the substrate 502 in the same transfer zone 500.

A spacing or gap G1 between adjacent wiping elements of FIG. 7 is different to another spacing or gap G2. This has an influence on the lane width. A greater gap will create a greater lane width. A lifted part 506 of the substrate 502 comprises a zone 504 that is greater that a combined width of the wiping elements 521, 522. Although each wiping element 521, 522 is spaced apart from another one of the wiping elements 521, 522, each wiping element 521, 522 is to direct a force to a respective portion of the zone 504 of the substrate 502. That is, each zone 504 will comprise a free span of lifted substrate between the portions of the substrate 502 that are physically acted on by each wiping element 521, 522.

In some instances, the distance between each wiper 510, 520, 530, 540 may change for example by a controller. The spacing or gap G1, G2 between each wiping element 521, 522 may also change. Such changes may occur during a print job, which is "on-the-fly". A lane patterns can be changed quickly using the same anilox roller, for example, when an anilox roller is used as the transfer member.

Figure 8:
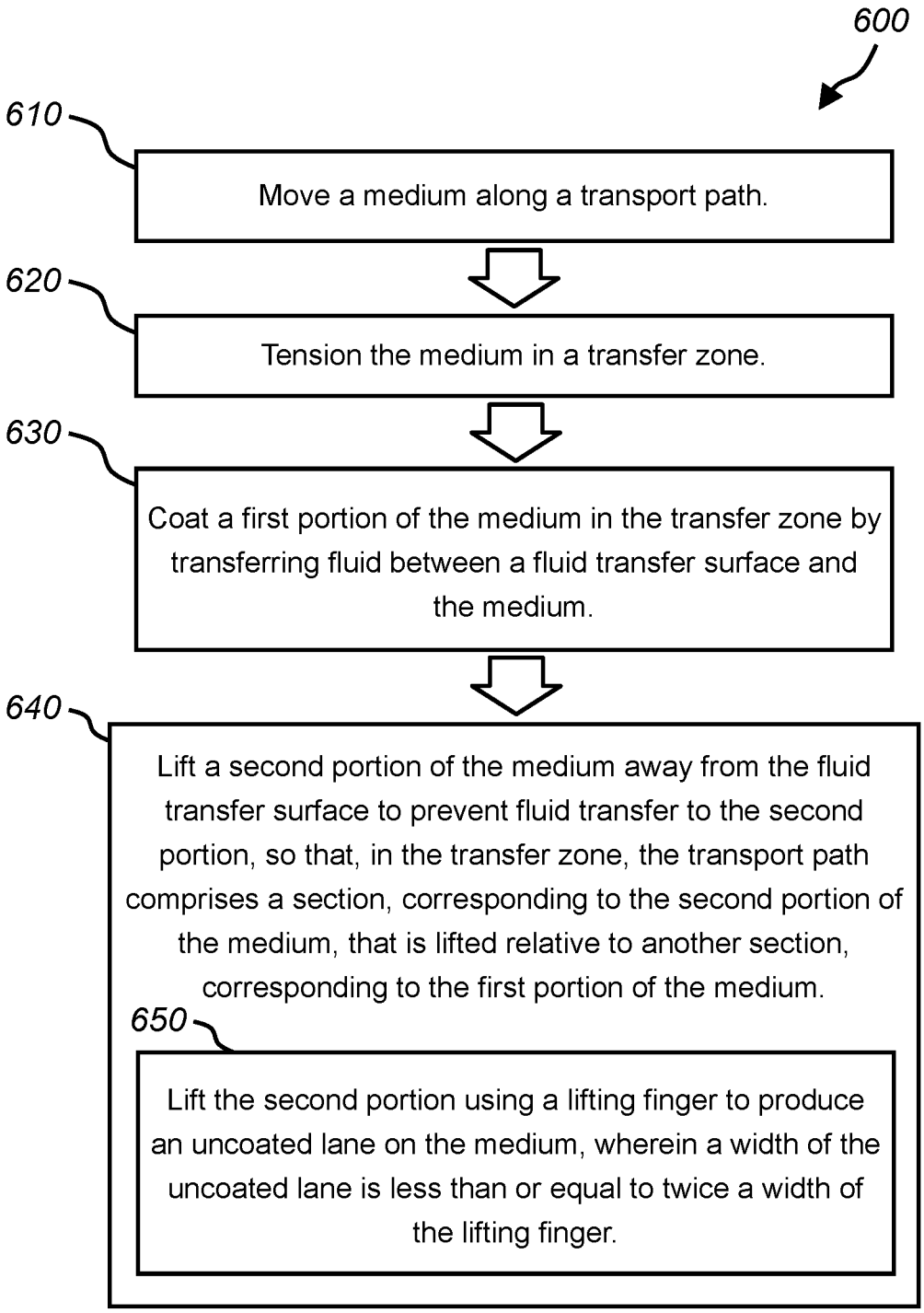
FIG. 8 is a flow diagram showing a method in accordance with an example.

FIG. 8 illustrates a flow diagram of a method 600. The method 600 can be performed by any one of the substrate coating system 100 discussed in relation to FIG. 1 or printers 101, 102 discussed in relation to FIGS. 2 and 3, respectively.

At block 610, the method 600 comprises moving a print medium along a transport path. The print medium comprises a substrate onto which printing fluid is printed. The substrate may be made of a synthetic material such as a polymeric material. A polymeric material enables good adhesion of the printing fluid to the substrate. The substrate may be paper, PETG (polyethylene terephthalate) or a laminated tube, for example. The print medium may be continuous, for example when the print medium is provided in web form, or discrete, for example when the print medium is provided in sheet form. The print medium may be fed on a per sheet basis, or from a roll sometimes referred to as a web substrate.

At block 620, the method 600 comprises tensioning the print medium in a transfer zone. In some instances, blocks 610 and 620 are interchangeable. In some other instances, the tensioning occurs before the moving and in others, the moving occurs before the tensioning.

At block 630, the method 600 comprises coating a first portion of the print medium in the transfer zone by transferring fluid between a fluid transfer surface and the print medium.

At block 640, the method 600 comprises lifting a second portion of the print medium away from the fluid transfer surface to prevent fluid transfer to the second portion, so that, in the transfer zone, the transport path comprises a section, corresponding to the second portion of the print medium, that is lifted relative to another section, corresponding to the first portion of the print medium.

In some examples, block 640 may comprise block 650. At block 650, the method 600 comprises lifting the second portion using a lifting finger to produce an uncoated lane on the print medium, wherein a width of the uncoated lane is less than or equal to twice a width of the lifting finger. In some examples, the directing the second portion may be with a plurality of lifting fingers or wiping elements such that the plurality of lifting fingers or wiping elements produce the same uncoated lane.

Certain system components and methods described herein may be implemented by way of non-transitory computer program code that is storable on a non-transitory storage medium. In some examples, the controller 260 shown in FIG. 4 for example may comprise a non-transitory computer readable storage medium comprising a set of computer-readable instructions stored thereon. The controller 260 may comprise at least one processor. Alternatively, at least one controller 260 may implement all or at least one part of the methods described herein.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A substrate coating system comprising:

a tension roller configured to apply tension to a substrate and rotate about an axis, wherein the rotation of the tension roller about the axis transports the substrate along a path including a transfer zone;

a transfer roller configured to transfer primer to the substrate, as the substrate is transported through the transfer zone and when a surface of the substrate is in proximity to the transfer roller;

a guide member including a plurality of wipers configured to lift portions of the substrate away from the transfer roller, such that uncoated lanes are created as the substrate passes through the transfer zone; and an adjuster coupled to the guide member, the adjuster providing a range of positions for the guide member along the width of the transfer roller.

2. The system of claim 1, wherein the system comprises: a controller configured to control the adjuster and change positions of the guide member along the width of the transfer roller.

3. The system of claim 1, wherein the plurality of wipers are arranged to create one or more uncoated lanes having a width of 8-10 mm.

4. The system of claim 1, wherein the plurality of wipers are arranged to create one of more uncoated lanes having a width of 4-6 mm.

* * * * *